United States Patent [19]

Berton et al.

[11] 4,265,500

[45] May 5, 1981

[54] METAL FURNITURE IN SECTIONAL UNITS

[75] Inventors: Marcello Berton, Ronchi di Massa; Pietro Ceccarelli, Massa, both of (Turin), Italy

[73] Assignee: Ing. C. Olivetti & C., S.p.A., Ivrea, Italy

[21] Appl. No.: 916,838

[22] Filed: Jun. 19, 1978

[30] Foreign Application Priority Data

Jul. 4, 1977 [IT] Italy ..... 68541 A/77

[51] Int. Cl.[3] ..... A47B 87/00; F16B 12/00

[52] U.S. Cl. ..... 312/107; 312/111; 312/257 SM; 312/257 A; 312/263; 211/192; 52/285

[58] Field of Search ..... 312/107, 108, 111, 140.1, 312/257 R, 257 SK, 257 A, 257 SM, 263; 211/192; 52/285, 270

[56] References Cited

U.S. PATENT DOCUMENTS

| | | | |
|---|---|---|---|
| 778,533 | 12/1904 | Dunbar | 52/285 |
| 1,109,086 | 9/1914 | Stuck | 312/111 |
| 2,179,307 | 11/1939 | Sywert | 312/257 A |
| 2,227,884 | 1/1941 | Gymer et al. | 312/111 |
| 2,505,299 | 4/1950 | Muller | 312/257 R |
| 2,514,631 | 7/1950 | Elvers | 312/107 |
| 2,869,953 | 1/1959 | Miller et al. | 312/263 |
| 3,056,639 | 10/1962 | Caminker et al. | 312/108 |
| 3,088,560 | 5/1963 | Preuss | 52/285 |
| 3,159,440 | 12/1964 | Courtwright | 52/285 |
| 3,736,599 | 6/1973 | Kessler et al. | 52/285 |
| 3,779,623 | 12/1973 | Motohashi | 312/111 |
| 3,791,707 | 2/1974 | House | 312/111 |
| 3,818,662 | 6/1974 | DeSchutter | 52/285 |
| 4,077,686 | 3/1978 | Bukaitz | 312/257 SK |

FOREIGN PATENT DOCUMENTS

| | | | |
|---|---|---|---|
| 2241952 | 3/1975 | France | 312/257 R |
| 76073 | 12/1949 | Norway | 312/257 |
| 679948 | 9/1952 | United Kingdom | 312/111 |
| 960362 | 6/1964 | United Kingdom | 312/257 SM |

*Primary Examiner*—Victor N. Sakran

*Attorney, Agent, or Firm*—Schuyler, Banner, Birch, McKie & Beckett

[57] ABSTRACT

A piece of metal furniture in sectional units comprises a base, two side panels, and a rear panel assembly. the assembly of these pieces is very simple and can be done by unskilled persons and without the use of any special tools or equipment. The base comprises complementary elements and locking devices which cooperate with corresponding parts of the side panels to allow the parts to be assembled and to be locked together, while taking up any relative play therebetween. The units are all of substantially parallelepipedal shape, resulting in less space being needed either for storing or for transport. The rear panel assembly is a modular assembly of individual rear panels wherein at least one dimension of the rear panel assembly is a multiple of the dimension of the base. Rear panels have the side edges which are suitably folded and shaped so as to interconnect with one another and with corresponding edges of the side panels. Considerable savings in production costs are made since all the units which make up the piece of furniture are obtained by using sheets of metal of restricted size.

16 Claims, 28 Drawing Figures

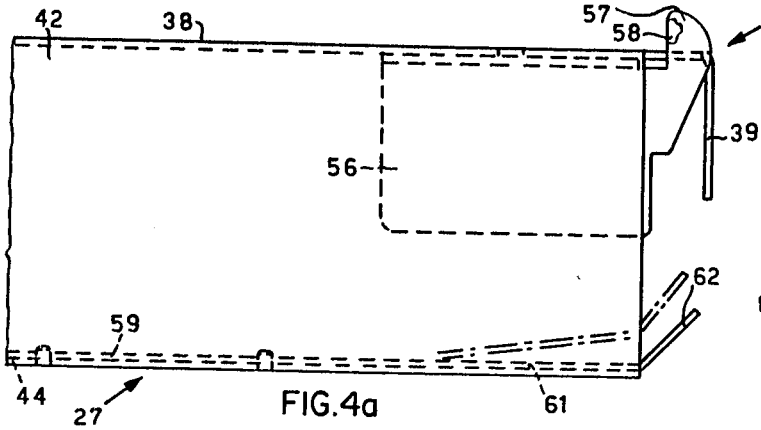
FIG.4a
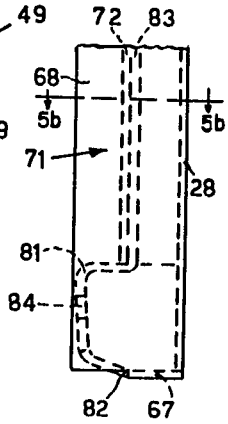
FIG.4b
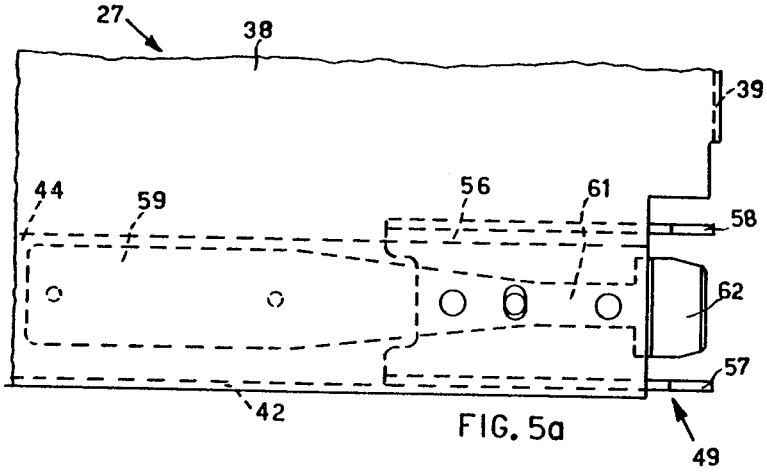
FIG. 5a
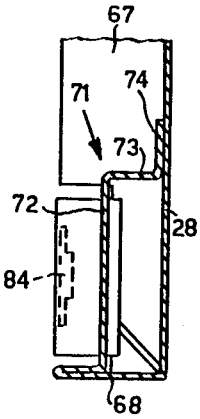
FIG.5b
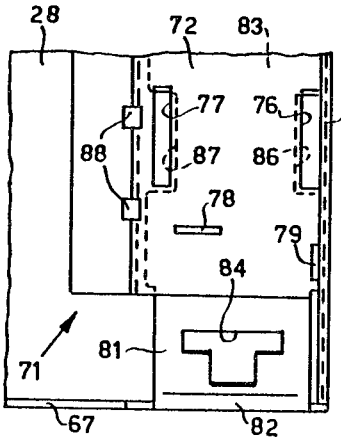
FIG. 6
FIG. 7
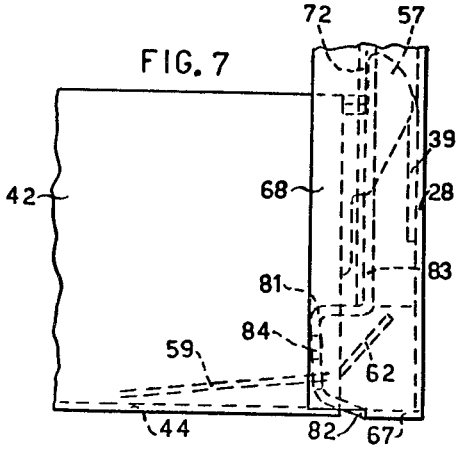

METAL FURNITURE IN SECTIONAL UNITS

BACKGROUND OF THE INVENTION

The present invention relates to a piece of metal furniture in sectional units which can be assembled and dismantled quickly and easily and without special tools being required.

The sectional nature of the prior art furniture has yielded in a reduction in cost on account of the restricted size of the parts. Restricted size is an advantage not only during storage and carriage but also during manufacture, since it is easier to produce and handle parts of restricted dimensions. This design does, however, have the disadvantages of reduced strength and of specialised staff being needed to assemble the component parts of the piece of furniture itself.

SUMMARY OF THE INVENTION

The technical problem which the present invention proposes to solve is, therefore, that of producing a piece of metal furniture in sectional units which will be sufficiently strong and will not require either tools or specially skilled staff to assemble the various units.

This technical problem is solved by the piece of furniture in accordance with the invention which is characterised by different units which determine the angular position between the parts to be assembled and by locking devices which can be moved from a first position, in which they allow the said parts to be assembled, to positions in which they lock the parts against the corresponding complementary units thereby allowing for the appropriate play.

BRIEF DESCRIPTION OF THE DRAWING

The invention will now be described, by way of example only, in terms of a preferred embodiment, reference being made to the attached drawings, in which:

FIG. 4*a* is a front elevational view of a portion of the base;

FIG. 4*b* is an end elevational view of a portion of the side panel of the furniture of FIG. 1;

FIG. 5*a* is a top plan view of the portion of the base of FIG. 4;

FIG. 5*b* is a sectional view taken along line 5*b*—5*b* in FIG. 4*b;*

FIG. 6 is a side elevational view of the portion of the side panel of FIG. 4*b;*

FIG. 7 is an elevational view of the base and side panel portions of FIGS. 4*a* and 4*b* joined together;

DESCRIPTION OF THE PREFERRED EMBODIMENT

Figure 1:
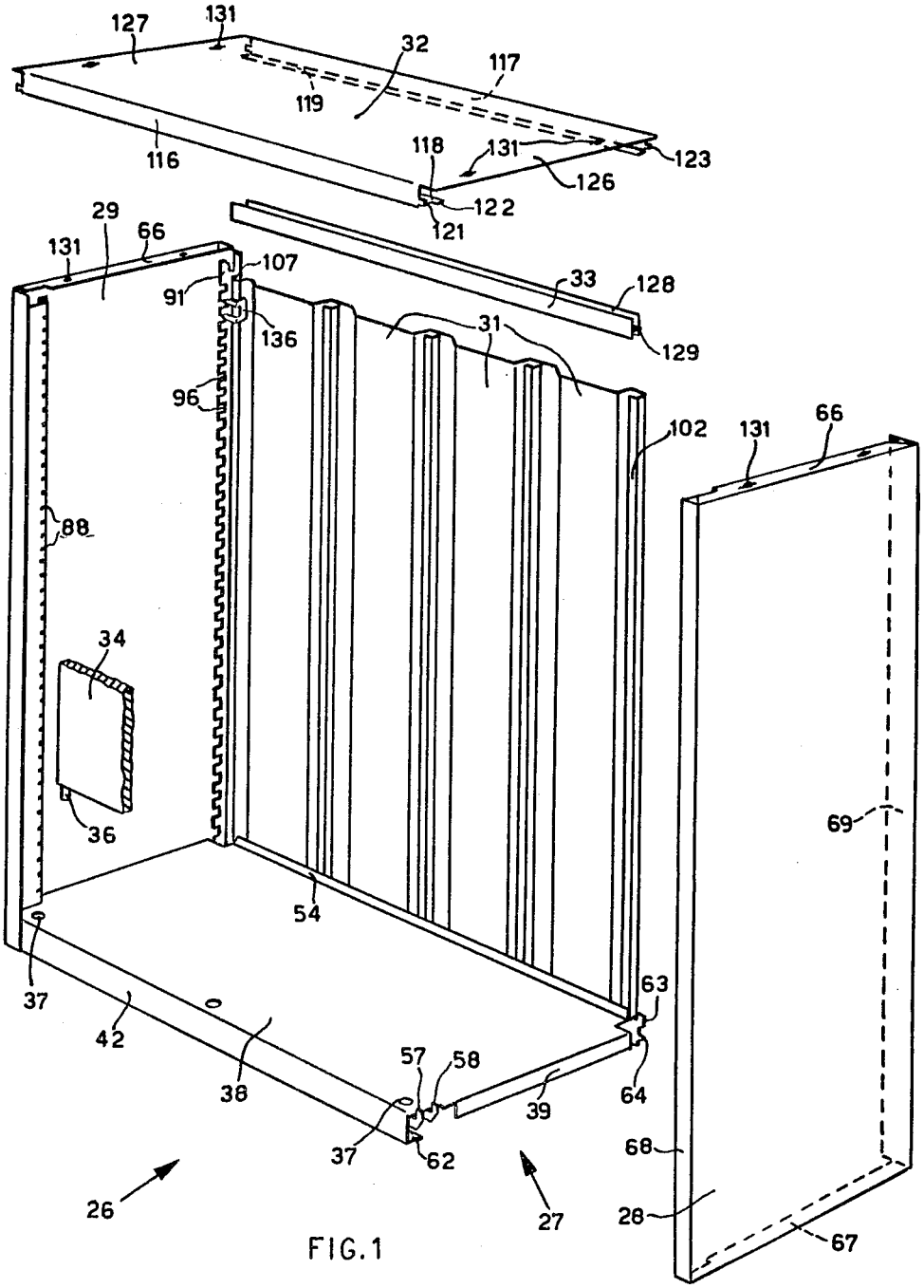
FIG. 1 is an exploded perspective view of the piece of metal furniture in sectional units according to the invention.

With reference to FIG. 1, the piece of metal furniture in sectional units shown generically by 26, includes a base 27, two side panels 28 and 29, a series of interconnected rear panels 31, a cover 32, a connecting cross-piece 33 applied between the panel 31 and the cover 32 and a door 34 of a known type and partly shown, which turns on pivots 36 (only one visible) in the holes 37 in the base 27 and the cover 32 (not visible).

Figure 2:
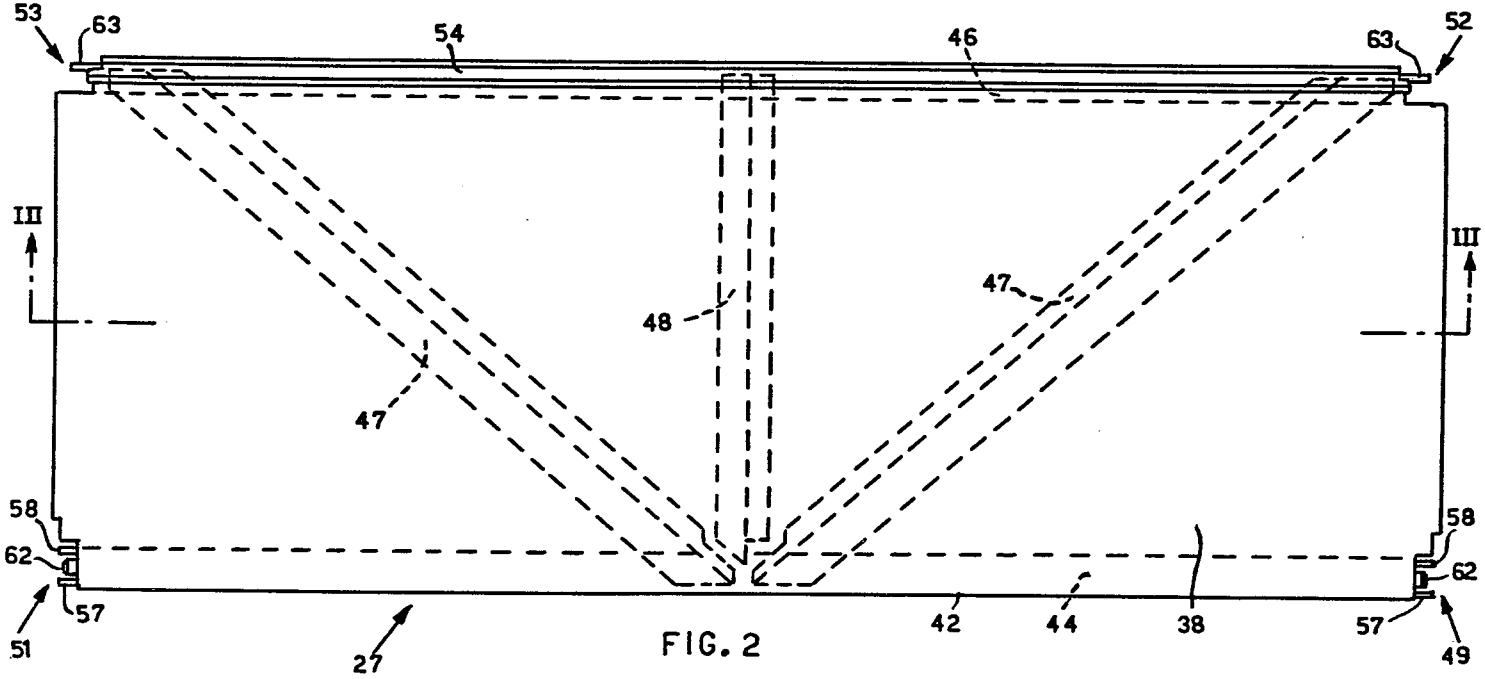
FIG. 2 is a top plan view of the base of the furniture of FIG. 1.
Figure 3:
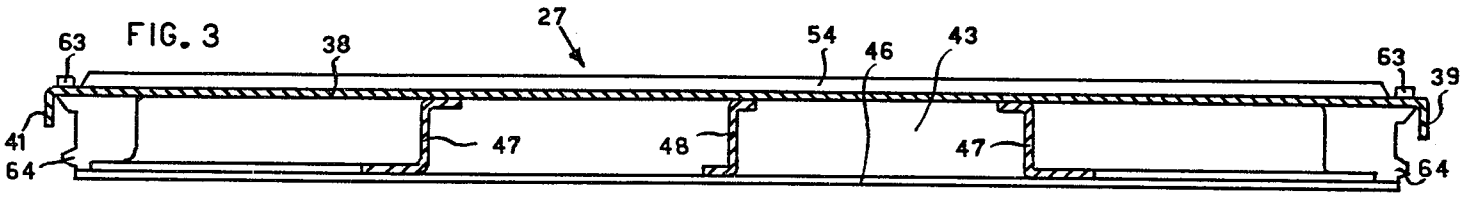
FIG. 3 is a sectional view of the same taken along line 3—3 in FIG. 2.

The base 27 consists of a sheet of metal which forms a face 38 and is folded on the four sides to mark the limits of two different units or side walls 39 and 41 (FIG. 3) in a L shape, one front wall 42 (FIG. 1) and one rear wall 43 (FIGS. 2 and 3) in a U shape. The front 42 and rear 43 walls define the limits of a lower edge, 44 and 46 respectively, by which the base 27 rests on the ground. The base 27 is strengthened by a pair of Z-shaped cross ribs 47, which are arranged in a V shape under the face 38 so that the apex of the V is in the central part of the front wall 42 while the ends of the V are against the rear wall 43. A third Z-shaped cross rib 48, connects the apex of the V to the centre of the rear wall 43. The base 27 includes two front corners 49 and 51 and two rear corners 52 and 53 adjacent to the ends of the V of the cross ribs 47. Finally, the base 27 includes a U-shaped support unit 54 applied to the face 38 along the rear wall 43.

The walls, 39, 41, 42 and 43 are interrupted at the corners 49, 51, 52 and 53. The front corners 49 and 51 are identical to one another, as are the rear corners 52 and 53: Consequently, for the sake of simplicity, only corners 49 and 52 will be described.

The corner 49 includes as a locking device a U shaped unit 56 (FIGS. 4*a* and 5*a*) which is fixed against the internal parts of the face 38 and of the front wall 42, and has two identical engagement means or hooks 57 and 58 which project above face 38, and a leaf spring 59 with one end fixed to the inside of the lower edge 44. The leaf spring 59 is normally supported against the inside of the lower edge 44 and can be bent towards the hooks 57 and 58, either manually or by means of a screwdriver or another simple device. The spring 59 has a central part 61 which is tapered in relation to the fixed part. It is substantially rectangular in shape and terminates in a broadened end 62 of a trapezoid shape, which is bent at approximately 45° to the central part 61 towards the hooks 57 and 58.

The corner 52 (FIGS. 8*a* and 9*a*) includes a hook 63 which projects above face 38, and a lower blade 64. Both the hook 63 and the blade 64 are extensions of the lower wall 43.

Right and left side panels 28 (FIG. 1) and 29 are mirror images of one another; consequently, only one is described. Panel 28 consists of a sheet of metal which forms the side surface of the piece of furniture, folded on the four sides to define an upper edge 66, a lower edge 67 by means of which it rests on the floor, and two sidewalls 68 and 69. The sidewall 68 (FIG. 5*b*) is substantially perpendicular to the panel 28 while the end of the metal sheet is folded over again against the wall 68, thereby forming a box 71 which consists of a wall 72 substantially parallel to the panel 28, of a second wall 73 substantially perpendicular to the panel 28 and of an edge 74 fitting close to the panel itself.

Figure 14:
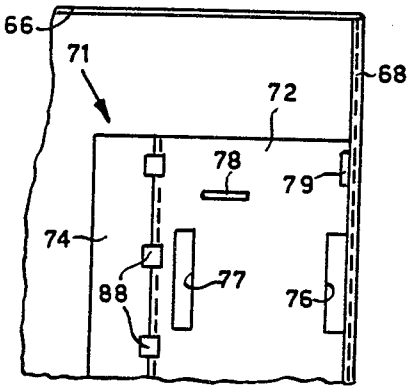
FIG. 14 is a side elevational view of another portion of a side panel.

The box 71 is spaced from the upper edge 66 (FIG. 14) and from the lower edge 67 (FIG. 6) and includes, at each end, a series of four eyelets 76, 77, 78 and 79. A hooking unit 81 is fitted between the lower edge 67 and the end of the box 71 if the panel 28 is right hand or between the edge 66 and the end of the box 71 if the panel is left hand. It is obvious that the fabrication process is the same for panels 28 and 29 so that it is enough merely to turn the panel by 180° and to apply the hooking unit 81 in order to distinguish the right hand panel 28 from the left hand panel 29.

The hooking unit 81 (FIGS. 4*b*, 5*b*, 6 and 7) consists of a metal plate with one end 82 welded to the lower edge 67 and a rectilinear part 83 which penetrates into the box 71 against the wall 72 to reinforce it. The hooking unit 81 is slightly bent in relation to the panel 28 and includes a T shaped eyelet 84 which is able to engage with the leaf spring 59 during the assembly of the piece of furniture 26 as described below. In alignment with the eyelets 76 and 77 of the wall 72, the rectilinear part 83 has two grooves 86 and 87 which are able to engage with the hooks 57 and 58 in the base 27. In addition, a series of grooves 88 are made between the wall 73 and the edge 74 in order to house shelf supports (not shown on the drawings).

The side wall 69 (FIGS. 8*b*, 9*b*, 10 and 11) is substantially perpendicular to the panel 28, has a part folded over by 180° and terminates in an edge 91 which is substantially parallel to the panel 28. The edge 91 is spaced from the upper edge 66 and the lower edge 67; it includes at each end two eyelets 92 and 93 and a groove 94. In addition, the edge 91 includes a series of grooves 96 which are arranged on the same horizontal plane as the grooves 88 (FIG. 6) in order to house the shelf supports (not shown on the drawings).

The rear panels 31 (FIG. 1) are connected to one another to form a single rear wall or panel assembly. The width of the rear wall is, therefore, a multiple of the dimension of the base. Each panel 31 (FIGS. 18*a* & *b* and 19*a* & *b*) consists of a single shaped and folded sheet of metal and includes a central part which is substantially straight which is attached by means of a sloping wall 98 and a straight wall 99, which are parallel with the central wall, to an L-shaped end 102 which is bounded by a wall 103 which is substantially perpendicular to the central part 31. Finally, the end 102 includes an edge which is folded over the wall 103 to reinforce the end. The central wall 31 is connected by a second sloping wall 104 and a straight wall 106 to the other end 107 which, in turn, includes a first wall 108 and a second wall 109 which are perpendicular one to the other, and a wall 111, sloping at approximately 45° in relation to the central wall. Finally, the end 107 includes an edge which follows the walls 111, 109 and 108 to reinforce the end itself.

Figure 13:
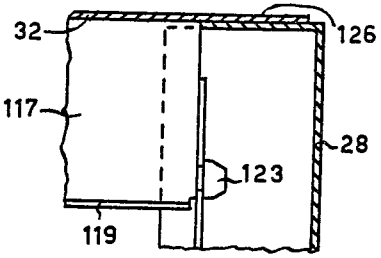
FIG. 13 is an elevational view, partly in section, of the cover of the furniture of FIG. 1 joined to the portion of the side panel of FIG. 12.
Figure 15B:
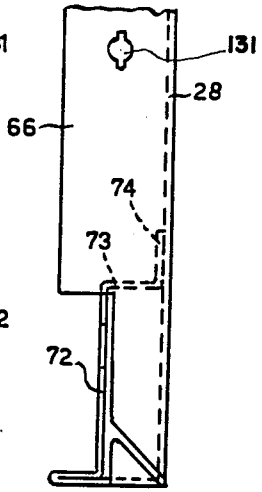
FIG. 15*b* is a top plan view of another portion of a side panel.
Figure 15A:
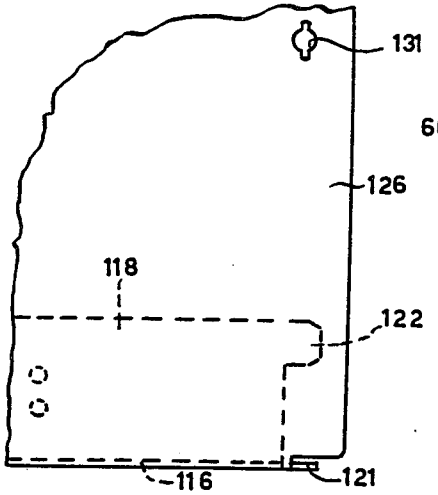
FIG. 15*a* is a top plan view of a portion of the cover.

The cover 32 (FIG. 1) consists of a single metal sheet folded on the flat side and on the rear side to mark the limit of a front 116 and a rear wall 117, both of a U-shape. Walls 116 and 117 define edges 118, 119 respectively. The front wall 116 (FIG. 15*a*) and the edge 118 each end in a blade 121 and 122. The rear wall 117 (FIG. 13) also ends in a blade 123. The ends 126 and 127 (FIG. 1) of the cover 32 project beyond the blades 121, 122 and 123 and engage, when the piece of furniture 26 is being assembled, with the upper parts of the side walls 28 and 29.

Figure 20:
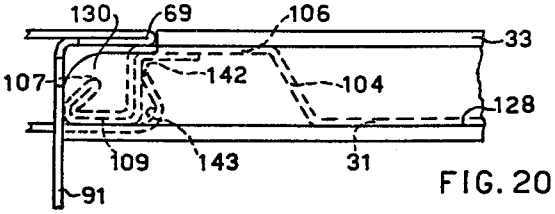
FIG. 20 is a top plan view similar to FIG. 18*a* with a connecting cross piece shown in position.

The connecting crosspiece 33 consists of an H-shaped plate with an upper channel 128 which is houses the rear edge 119 of the cover 32, and a lower channel 129 which is houses the upper edges of the rear panels 31. The ends 130 (FIG. 20) of the connecting crosspiece 33 are L-shaped in order to engage with the side wall and thereby to close the rear part of the piece of furniture 26.

Figures 8A, 8B, 9A, 9B, 10, 11:
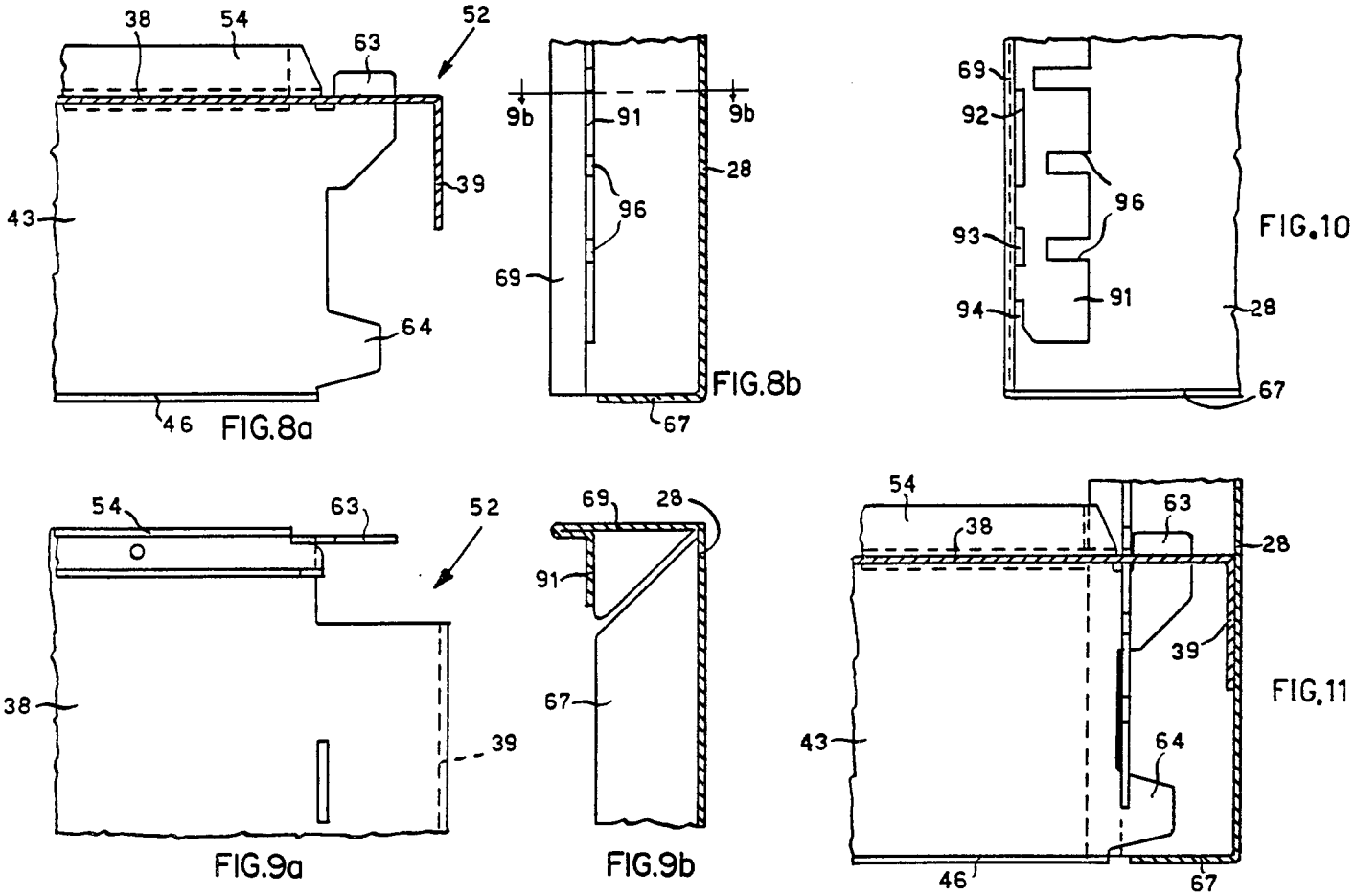
FIG. 8*a* is an elevational view, partly in section, of another portion of the base.
FIG. 8*b* is a front elevational view, partly in section, of another portion of a side panel.
FIG. 9*a* is a top plan view of the portion of the base of FIG. 8*a;*
FIG. 9*b* is a sectional view taken along line 9*b*—9*b* in FIG. 8*b;*
FIG. 10 is a side elevational view of the portion of the side panel of FIG. 8*b;*
FIG. 11 is an elevational view, partly in section, of the base and side panel portions of FIGS. 8*a* and 8*b* joined together.

Assembly of the piece of furniture (FIG. 1) is done as follows:

The base 27 is placed on the floor and the side panels 28 and 29 are then fitted. Since fitting of the two panels is similar, in order to simplify matters, the fitting of the right hand panel 28 is described. The panel 28 is placed vertical with the eyelets 76 (FIGS. 5*a* & *b* and 6) and 77 in line with the hooks 57 and 58, the T shaped eyelet 84 in alignment with the end 62 of the leaf spring 59, the eyelet 92 (FIGS. 8 and 10) of the hook 63 and the groove 94 in alignment with the blade 64. The panel 28 is turned in an anticlockwise direction for about 45° until the hooks 57, 58 and 63 engage the respective eyelets, 76, 77 and 92. The panel 28 is then turned in a clockwise direction. During this turning movement, the end 62 (FIGS. 5*a* and 7) of the leaf spring 59 engages the T eyelet 84 and fits into the space bounded by the hooking element 81 and the internal wall of the panel 28. Turning continues until the blade 64 is engaged in the groove 94 and the panel 28 is perpendicular in relation to the base 27 as shown in FIGS. 7 and 11. The leaf spring 59 then fits into the small space of the T shaped eyelet 84 and, since the hooking unit 81 is inclined in relation to the panel 28, the leaf spring 59 pulls the panel itself, taking up any play between the hooks 57, 58 and 63 and the respective eyelets 76, 77 and 92. The panel 28 is, therefore, fixed firmly to the base 27 and with the lower edge 67 resting on the floor. The left hand panel 29 is fitted in the same way as described above.

The position of the angle of the side panel 28, 29 in relation to the base 27 is determined by the difference between the wall at L 39 and the internal part of the panel itself and so, the base 27 and the side panel 28, 29 lie on two substantially perpendicular planes. If an attempt is made to alter these positions by pressing on the side panel 28,29, turning the side panel 28, 29 in a clockwise or an anti-clockwise direction, both the coupling with the hooks 57, 58, 63 and eyelets 76, 77, 92 and the complementary parts of L shaped wall 39 and internal wall of the panel will prevent movement. Furthermore, the leaf spring 59 with the rectilinear part 61 will position itself deeper and deeper in the narrow part of the T shaped eyelet 84, taking up any further play and thereby increasing the strength of the connection between the two parts.

Figure 18A:
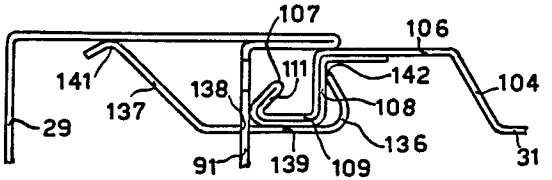
FIG. 18*a* is a top plan view of a rear and a side panel of the furniture joined together.
Figure 18B:
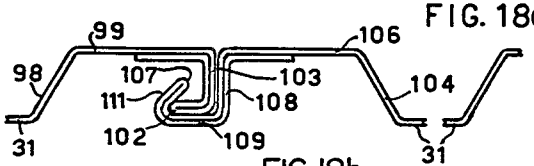
FIG. 18*b* is a top plan view of two rear panels joined together.
Figure 19A:
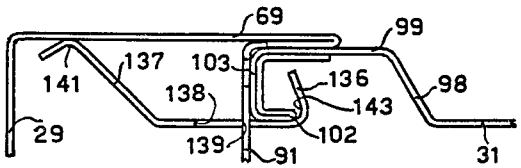
FIG. 19*a* is a top plan view of another rear and a side panel of the furniture joined together.
Figure 19B:
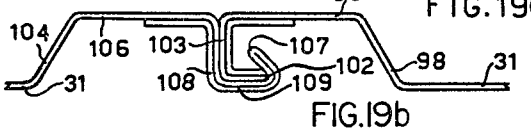
FIG. 19*b* is a top plan view of another two rear panels joined together.

The rear panels 31 (FIG. 1) are now fitted. A panel 31 is taken and fitted into the groove in the support unit 54 of the base 27 either with the end 102 (FIGS. 18*a* & *b* and 19*a* & *b*) or with the end 107 against the edge 91 either of the panel 28 or of the panel 29, in such a way that the edges of the ends 102 and 107 are turned towards the inside of the piece of furniture 26 as shown in FIGS. 18 and 19. For greater clarity, it is assumed that the first rear panel 31 is fitted as shown in FIG. 18*a*, namely with the end 107 against the edge 91. A second panel 31 is taken and arranged with the end 107 interconnected with the end 102; it is then fitted into the U-shaped groove of the support unit 54 (FIG. 1). This operation is repeated until all the panels 31 are fitted. The connecting crosspiece 33 is placed in position over the panels 31, with the far edges of the panels being fitted into the lower channel 129 as shown in FIG. 21.

The cover 32 (FIG. 1) is positioned with the rear edge 119 inside the upper channel 128 of the connecting crosspiece 33 and with the ends 126 and 127 over the upper edges 66 of the side panels 28 and 29. Panel 28 is turned slightly in a clockwise direction and panel 29 in an anticlockwise direction until the blades 121, 122 and 123 are arranged in alignment with the eyelets 78, 79 and 93. The panels 28 and 29 are returned to a vertical position and the cover is fitted with the blades 121, 122 and 123 fitted into the eyelets 78, 79 and 93.

Figure 16:
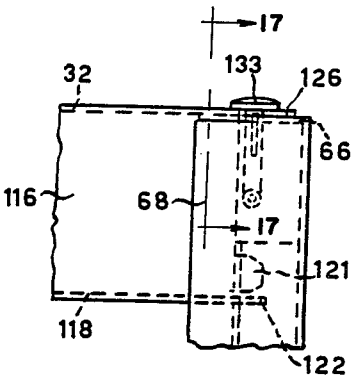
FIG. 16 is a front elevational view of the portions of the cover and side panel of FIGS. 15*a* and 15*b* joined together.
Figure 17:
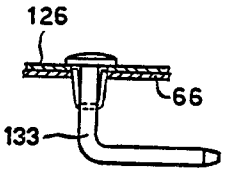
FIG. 17 is a sectional view taken along line 17—17 in FIG. 16.
Figure 12:
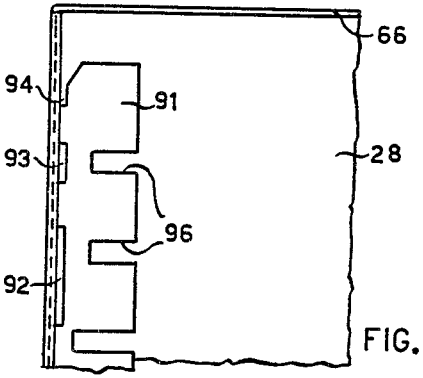
FIG. 12 is a side elevational view of another portion of a side panel.

In order to prevent the possibility of the cover 32 being moved as a result of movement or impacts from various causes, eyelet holes 131 (15*a* & *b*) are made in the cover 32 and in the upper edges of the side panels 28 and 29. These eyelets are able to house connecting pins 133 (FIGS. 16 and 17) which are fitted manually as shown in FIG. 17 and which prevent the cover 32 from moving.

Figure 21:
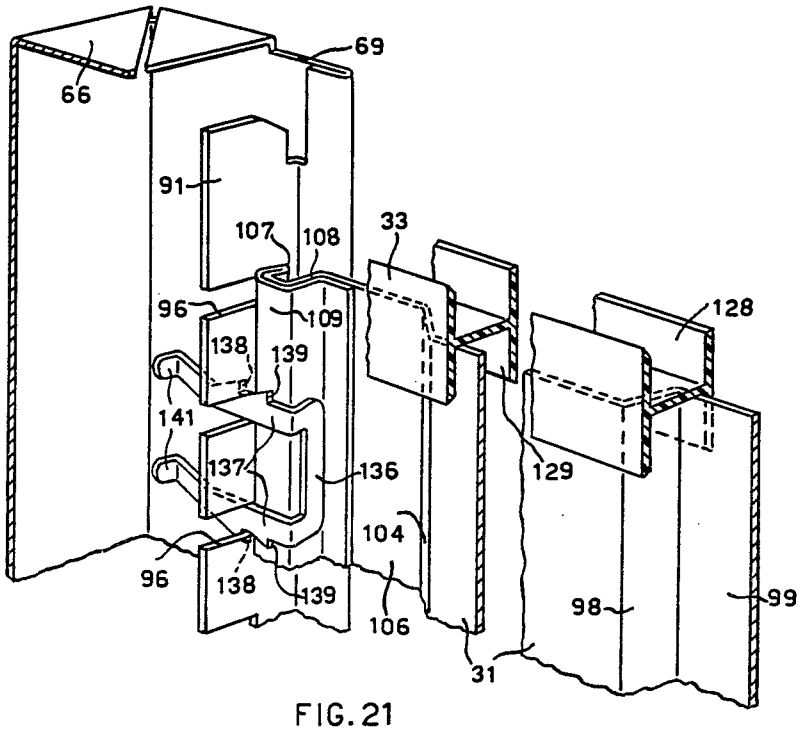
FIG. 21 is a perspective view, partly in section and with portions broken away, of the details of FIGS. 18–20.

In order to prevent the rear panels 31 from being able to move as the results of impacts or other causes, and therefore, in order to improve the rigidity of the piece of furniture 26, a pin 136 (FIGS. 18*a* & *b* 19*a* & *b* and 21) is applied between the ends 102 and 107 and the edge 91 as shown in FIGS. 18, 19 and 21. The pin 136 includes the arms or lugs 137, each of which has two teeth 138 and 139 which are formed on the outside edge of the arms themselves. Each arm 137 terminates in an end 141 which is connected to and able to engage with the internal part of the wall 69. FIGS. 18 and 19 show the application of the pin 136 on the two ends 102 and 107 of the rear panel 31. The following method is adopted to fit the pin 136.

The pin 136 (FIG. 21) is brought into correspondence with two grooves 96 and pressure is then applied to force the pin 136 towards the wall 69 until it engages with the teeth 138 against the edge 91 and with the end 141 urged against the wall 69 bending the pin itself. The panel 31 is thus held firm against the edge 91 by means of the spring pressure exerted by the corner 142 (FIG. 18*a*) against the wall 108 and by the teeth 138 against the edge 91 if the pin 136 is applied against the end 107 of the panel 31. If, however, the pin 136 is applied against the end 102 (FIG. 19*a*) the panel 31 is held firm against the edge 91 by the spring pressure exerted by the jointed corner or lug 143 against the end 102 of the panel 31 and by the teeth 139 against the edge 91.

It is, therefore, obvious that a single type of pin 136 is able to create a stable locking effect between the full rear wall 31 and the side walls 28 and 29. In particular, the pin 136 applied between the ends 102, 107 and the edge 91 of the left hand panel 29 locks the rear panel on the left while the pin 136 applied between the ends 107, 102 and the edge 91 of the right hand side panel 28 locks the panel on the right.

As seen from the above description, the assembly of the piece of furniture 26 is very simple and can be done by unskilled persons and without the use of any special tools or equipment. Furthermore, since the units which make up the piece of furniture 26 are all substantially parallelipedal in shape, they result in less space being needed either for storing or for transport. Finally, considerable savings in production costs are realized since all the units which make up the piece of furniture 26-base 27, side panels 28 and 29, rear panels 31 and cover 32-are obtained by using sheets of metal of restricted size. The fabrication process is simple with only cutting being used for holes, grooves and eyelets while the subsequent folding operations can be done on automatic machines.

In order to dismantle the piece of furniture, the opposite procedure to that described above is used. Firstly, the connecting pivots 133 (FIG. 17) are removed: then, the right hand panel 28 (FIG. 1) is turned in a clockwise direction and the left hand panel 29 is turned in an anticlockwise direction to disengage the blades 121, 122 and 123 of the cover 32 from the respective eyelets 78, 79 and 93 and the cover 32 is lifted off. The connecting crosspiece 33 is then removed and the pins 136 are removed with a screwdriver or a similar device. The rear panels 31 are free to be lifted and removed from the support unit 54. The base 27 with the side panels 28 and 29 is raised slightly and the screwdriver or device used for the pins 136 is slipped between the edge 44 (FIG. 7) and the leaf spring 59 which holds one of the two panels, to bend it towards the hooks 57 and 58. The end 62 of the spring 59 is positioned in the wide part of the T eyelet 84 as a result of which, when the left hand panel 29 is turned in a clockwise direction and the right hand panel 28 in an anticlockwise direction, each panel is released from the hooking unit 81 of the spring 59. The side panel 28 or 29 is, therefore, free to be lifted off, thus completing the dismantling of the piece of furniture 26.

It is possible to introduce changes and improvements to the piece of metal furniture in sectional units, either in the shape or in the arrangement of the various parts without departing from the scope of the invention. For example, the dimensions of the piece of furniture can vary at the user's request. In the case of a piece of furniture 26 with different measurements, the dimensions of the base 27 and of the cover 32 will vary but as far as the rear wall is concerned, only the number of modular rear panels 31 will vary. Furthermore, in the case of very large pieces of furniture, it is possible to fit in the central part, front and back respectively, between the base 27 and the cover 32, two columns acting as struts, fitted with notches to hold the shelves and held compressed by two braces which divide the piece of furniture into two parts and, at the same time, prevent movement of loads deposited on the shelves from one part to the other.

What we claim is:

1. A metal furniture comprising a series of parts assembled together, wherein two of said series of parts include coupling means for coupling said parts together upon relative rotation thereof, alignment means comprising complementary elements for determining a fixed predetermined relative angular position of said two parts when they are assembled and locked together, locking means movable from an initial position corresponding to an engaged relative angular position of said two parts near said predetermined angular position, to successive locking positions in which said locking means locks said two parts together with the complementary elements in engagement with one another, and spring means for urging said locking means from said initial position to said successive position for taking up any relative play between said complementary elements throughout the range of said successive locking positions between said engaged and predetermined angular positions upon assembly of said two parts.

2. A metal furniture according to claim 1, wherein said two parts comprise a base and at least one side panel which lie on two substantially perpendicular planes when assembled, wherein said base and said side panel include said coupling means, said complementary elements and said locking means, and wherein said complementary elements and said locking means maintain said base and said side panel substantially perpendicular to each other.

3. A metal furniture according to claim 2, wherein said coupling means and said locking means of said base comprise hook elements and a leaf spring, and wherein said side panel comprises grooves and a slot for cooperating with the hook elements and the leaf spring of said base, respectively.

4. A metal furniture according to claim 3, wherein said complementary elements comprise a shoulder of said base and an opposing surface of said side panel adjacent said grooves and said slot.

5. A metal furniture according to claim 1, wherein said locking means comprise an arrest element fixed on one of said two parts and a hook element movable on the other of said two parts, said spring means comprising a leaf spring having a portion fixed on the other of said parts and another portion carrying said hook element.

6. A metal furniture according to claim 5, wherein said hook element is constituted by one end of said leaf spring.

7. A metal furniture according to claim 5, wherein said two parts comprise a base and one side panel, said complementary elements comprise a shoulder of said base and an opposing surface of said side panel, said leaf spring being fixed on said base and said arrest element being fixed on said side panel adjacent said opposing surface and being arranged at an angle in relation to the opposing surface, said shaped end of said leaf spring being able to engage said arrest element during the assembly of said base and said side panel for locking them together and for allowing the play constantly to be taken up between said base and said side panel.

8. A metal furniture as in claim 1, wherein said locking means include on one of the parts a connecting unit and, on the other of said two parts, a contact surface wherein said connecting unit has an initial position for the engagement with the other of said two parts, and said contact surface is cooperative with said connecting unit during the assembling of said two parts, and wherein said connecting unit is held by said spring means in a rest position and is moved by said contact surface from said rest position to said initial position against the action of said spring means during the rotation for the assembly of said two parts, said connecting unit snapping on one of said locking positions near said rest position under the action of said spring means to lock said two parts in said engaged angular position after the assembly thereof.

9. A metal furniture as in claim 8, wherein said spring means comprises a leaf spring portion of said connecting unit which has one end fixed to one of the parts and wherein the other end of said leaf spring is T shaped so as to engage a T shaped eyelet of a hooking portion of said contact surface.

10. A metal furniture as in claim 9, wherein said two parts include a base and at least one side panel which, when assembled, lie on two substantially perpendicular planes, wherein said one end of the leaf spring is fixed to said base and the contact surface is fixed to the side panel and wherein said hooking portion is arranged at an angle in relation to said complementary elements so as to allow the play constantly to be taken up for maintaining the perpendicularity of said base and side panel.

11. A metal furniture according to claim 1, wherein one of said two parts comprises two opposite surfaces, wherein said coupling means comprises hooking units which project from one of said opposite surfaces and said locking means project from the other of said opposite surface.

12. A metal furniture according to claim 11, wherein the other of said two parts comprises a box having means for cooperating with said hooking units and said locking means during the assembling of said two parts.

13. A metal furniture according to claim 12 wherein said spring means, said box and said hooking units are diposed at corners of said two parts.

14. A metal furniture in sectional units comprising a base and at least one side panel, and having a series of hooks and a series of eyelets which cooperate to define a transverse relative position of said base and said side panel to allow a rotation thereof from a first position, in which the base and the side panel can be initially engaged together, complementary elements defining a perpendicular relative position of the base and the side panel, a T shaped eyelet formed on said side panel, a T shaped hook projecting from the base for engaging the T shaped eyelet, and a spring element urging the T shaped hook for locking the base and the side panel in successive locking positions defining a range of relative angular positions of said base and said panel near said perpendicular position, and wherein said T shaped hook is moved by the T shaped eyelet from a rest position into an engagement position against the action of the spring element during the assembly of the base and of the side panel, and wherein said spring element causes a snap movement of the T shaped hook from the engagement position to the locking position for locking the base and the side panel together.

15. A metal furniture according to claim 14, wherein the complementary elements comprise a shoulder of the base and an internal part of the side panel.

16. A metal furniture according to claim 14, wherein the spring element comprises a leaf spring having a portion fixed on the base and another portion which defines the T shaped hook, said other portion being arranged at an obtuse angle in relation to the portion fixed on the base for the cooperation with the T eyelet of the side panel.

* * * * *